United States Patent [19]

van Lit

[11] 4,223,812

[45] Sep. 23, 1980

[54] WALL MOUNTED RECEPTACLE FOR AEROSOL CANS

[75] Inventor: Klass J. van Lit, Amstelveen, Netherlands

[73] Assignee: S. C. Johnson & Son, Inc., Racine, Wis.

[21] Appl. No.: 853,961

[22] Filed: Nov. 22, 1977

[30] Foreign Application Priority Data

Nov. 22, 1976 [GB] United Kingdom ..... 48668/76

[51] Int. Cl.[2] ..... B05B 17/00

[52] U.S. Cl. ..... 222/180; 222/402.13; 239/282; 251/231

[58] Field of Search ..... 222/174, 180, 181, 182, 222/505, 509, 402.13; 239/274, 282; 251/231, 251, 320; 141/360–363

[56] References Cited

U.S. PATENT DOCUMENTS

| | | | |
|---|---|---|---|
| 3,045,873 | 7/1962 | Ryan | 222/180 X |
| 3,220,613 | 11/1965 | Palmer et al. | 222/174 |
| 4,111,338 | 9/1978 | Cheng et al. | 222/180 |

FOREIGN PATENT DOCUMENTS

| | | | |
|---|---|---|---|
| 2151327 | 5/1972 | Fed. Rep. of Germany | 222/174 |
| 1286175 | 8/1972 | United Kingdom | 222/180 |

*Primary Examiner*—David A. Scherbel

[57] ABSTRACT

A wall-mountable device for holding a cylindrical aerosol container of the type having a tilt-actuatable valve stem for dispensing its contents. The device is characterized by a wall-mountable bracket receiving and supporting the container in fixed position and a shroud member substantially enclosing the container and the bracket. The shroud member defines an opening receiving the valve stem and is pivotally attached to the bracket at a point spaced from the valve such that the valve stem is tilted by the shroud member when the shroud member is pivoted.

2 Claims, 4 Drawing Figures

WALL MOUNTED RECEPTACLE FOR AEROSOL CANS

BACKGROUND OF THE INVENTION

This invention relates to aerosol dispensing devices and in particular to wall-mountable dispensing receptacles for aerosol containers.

Various devices are known in the prior art for supporting a cylindrical aerosol container in a readily accessible or conveniently located position such that the valve at one end of the cylindrical container may conveniently be actuated. One example is the device disclosed in U.S. Pat. No. 3,045,873. Such devices may be used for convenient dispensing in many places, including principal uses in public washrooms and the like. Air freshener sprays are a prime example of the type of product dispensed with such devices.

There are certain problems associated with such devices. Many of the devices in the prior art are difficult to actuate. With others, there is difficulty in inserting and removing a cylindrical aerosol container. In other cases, the mechanical requirements of such dispensing receptacles have prevented such devices from having a particularly pleasing or at least unobtrusive appearance. Finally, many of such devices are prone to wear out quickly during use.

BRIEF SUMMARY OF THE INVENTION

This invention provides a wall-mountable aerosol dispensing device which overcomes the problems and disadvantages associated with devices in the prior art. The device is used for holding a cylindrical aerosol container having, at a valved end, a valve cup and a tilt-actuatable stem protruding therefrom along the container axis. The device includes a wall-mountable bracket for receiving and supporting the container in fixed position to prevent radial movement thereof. The bracket has pivot bearings thereon spaced from the end which is adjacent to the valved end of the container. The pivot bearings define a pivot axis parallel to a radius of the container and preferably parallel to the wall surface on which the bracket is mounted. The device also includes a shroud member which substantially encloses the container and the bracket and is pivotally attached to the pivot bearings. The shroud member defines an opening receiving the tilt-actuatable stem such that pivoting of the shroud member tilts the valve stem to dispense the contents of the aerosol container.

The shroud member serves the dual purpose of actuating the valve and enclosing the container and the mounting bracket to provide or allow a pleasing appearance in the device. The location of the pivot bearings may readily be chosen such that minimal pivoting movement of the shroud member will firmly tilt the tilt-actuatable valve stem to actuate the valve.

One specific use of this invention is the mounting of an aerosol air freshener device in public facilities in which odor control is deemed important. In such uses the container is preferably mounted in substantially upright position with the valved end at the top. The device of this invention is so conveniently actuated, simply by lightly pushing a portion of the shroud to provide a lever action, that the likelihood of actuation by the passing public is extremely good. Another use of this invention is the dispensing of hand soaps, hand creams and the like. In such applications the cylindrical container is preferably mounted vertically with the valved end located at the bottom.

The device of this invention is reliable and durable in operation. Such reliability and durability arise from simplicity of operation, there being only one moving part in addition to the normal aerosol valve. The device requires no springs or small moving parts other than those normally associated with the aerosol container itself.

OBJECTS OF THE INVENTION

One object of this invention is to provide a dispensing receptacle for an aerosol container which overcomes the aforementioned problems and difficiencies of the prior art.

Another object of this invention is to provide a dispensing receptacle for an aerosol container which is conveniently operated.

Yet another object of this invention is to provide a dispensing receptacle for an aerosol container which is conveniently loaded and unloaded of containers.

Another object of this invention is to provide a dispensing receptacle which has the aforementioned advantages while being, or having the capacity to be, pleasing in its outward appearance.

These and other objects will be apparent from the description of preferred embodiments including the drawings.

DETAILED DESCRIPTION OF PREFERRED EMBODIMENTS

Figure 1:
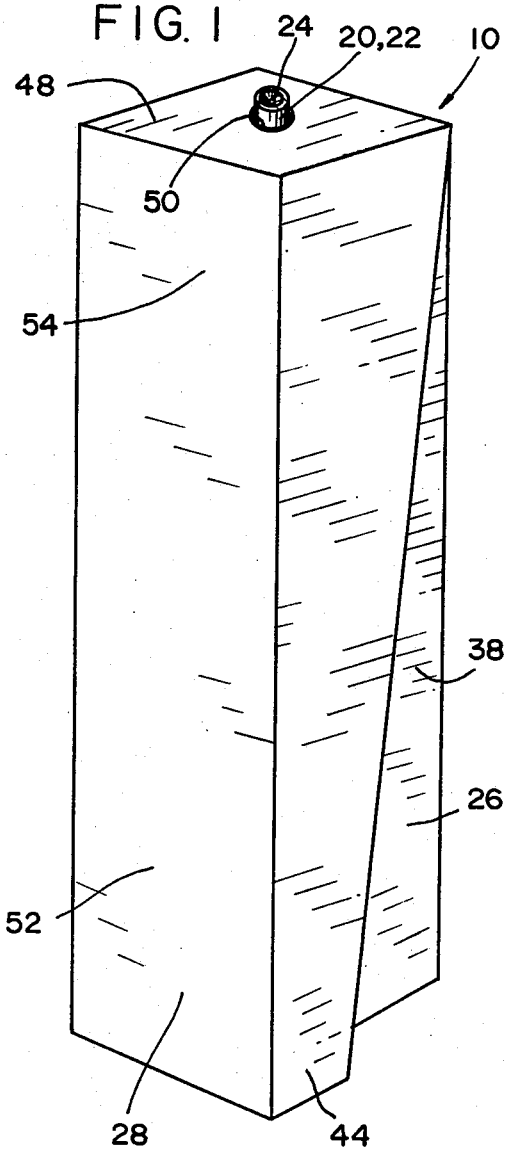
FIG. 1 is a perspective view of a preferred dispensing receptacle according to the invention.

The figures illustrate a preferred wall-mountable aerosol dispensing device 10 for holding and dispensing the contents of an aerosol container 12. Aerosol dispensing device 10 is attached to a wall 42 by means of fasteners 56, which may be common screws or other known fasteners.

Container 12 is a standard cylindrical aerosol container having a valved end 14 including a valve cup 16 and its associated valve 18. Valve 18 includes a tilt actuatable valve stem 20 which protrudes from valve cup 16 along the axis of cylindrical container 12. Stem 20 includes an outer extension portion 22 which is fitted to the inner portion of stem 20. Extension portion 22 is firmly attached to the inner stem portion such that all of stem 20 will tilt as one. Extension portion 22 of stem 20 is configured to provide a dispensing orifice 24 through which the contents of container 12 may be sprayed when stem 20 is tilted to actuate valve 18.

Wall-mountable aerosol dispensing device 10 has two principal parts, bracket 26 and shroud member 28, each in the form of a generally rectangular box structure having an open side. The open side of the structure of shroud member 28 is slightly larger than the open side of bracket 26, allowing shroud member 28 to be positioned over bracket 26 in telescoping fashion.

Bracket 26 includes a support surface 30 on which container 12 stands. The open side of the structure of bracket 26 is cut back on a slanted plane from support surface 30 to the upper surface 32, which is at a level just above rim 34 of valve cup 16. Attached to and downwardly depending from upper surface 32 is a tab 36 which extends into valve cup 16 and provides, together with the side walls 38 and shaped support member 39 of bracket 26, a means to secure cylindrical container 12 in bracket 26 and prevent radial movement thereof.

Figure 2:
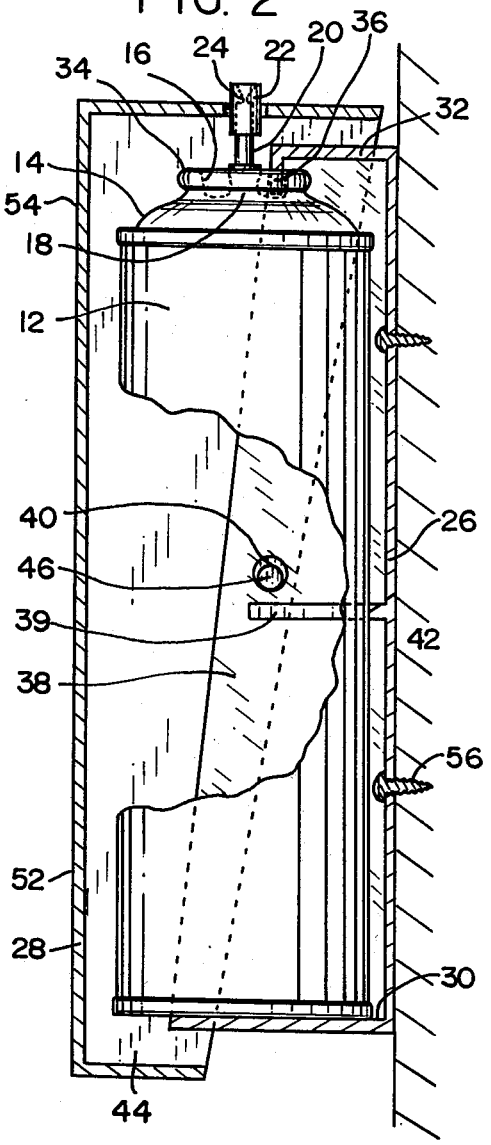
FIG. 2 is a side sectional view of FIG. 1, showing a portion of a mounted aerosol container (not in section).
Figure 3:
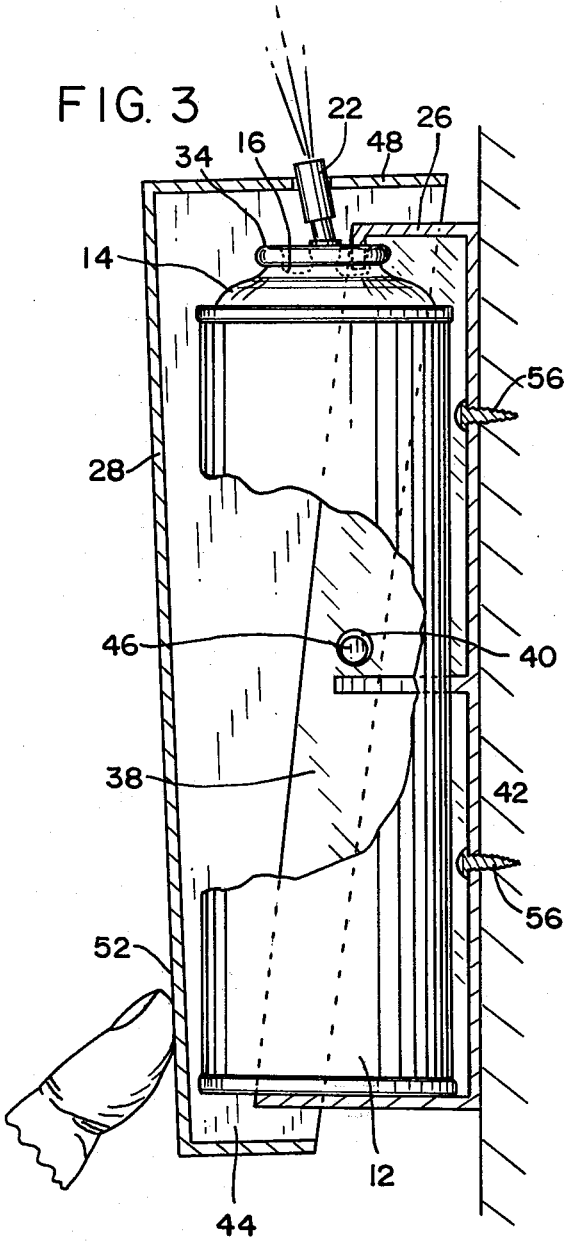
FIG. 3 is a side sectional view as in FIG. 2, showing, however, the device in actuated condition.
Figure 4:
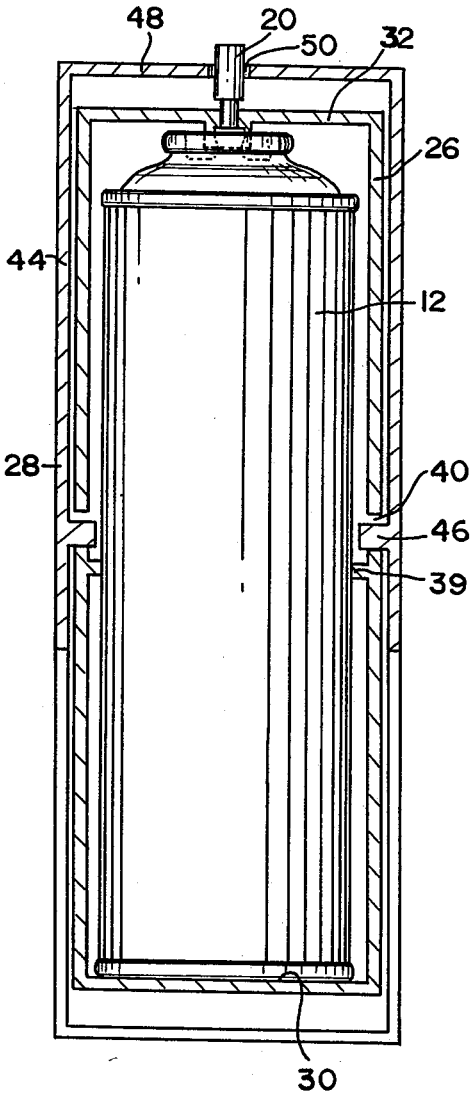
FIG. 4 is a front sectional view taken at section 4—4 as shown in FIG. 2, showing a mounted aerosol container in full view rather than sectional view.

An aperture 40 is defined about midway along the length of each of side walls 38 of bracket 26. Apertures 40 provide pivot bearings by which shroud member 28 is attached to bracket 26, as best shown in FIG. 4. Apertures 40 define a pivot axis parallel to a radius of container 12 and parallel to the surface of wall 42 shown in FIGS. 2 and 3.

Shroud member 28 substantially encloses container 12 and bracket 26. Shroud member 28 has side walls 44 which are substantially parallel to and spaced from the side walls 38 of bracket 26 when shroud member 28 is attached to bracket 26. Extending inwardly from each of side walls 44 of shroud member 28 are pivot pins 46 which function as pivot means when engaged with apertures 40. Shroud member 28 is attached to bracket 26 through pivot pins 46, being held thereby in its generally telescoping relationship with bracket 26, as shown in FIG. 4. Shroud member 28 has an upper surface 48 which extends over upper surface 32 of bracket 26 and over valved end 14 of container 12. Upper surface 48 defines an opening 50 receiving and engaging stem 20 such that dispensing orifice 24 is directed outside of dispensing device 10.

The locations of pivot pins 46 and apertures 40 are chosen such that the lever-like pivoting action of shroud member 28, through a very small arc, will easily tilt stem 20 sufficiently to actuate valve 18. Such pivoting movement may be effected by applying hand pressure on either the lower front portion 52 or the upper front portion 54 of shroud member 28. Markings may be placed on either lower front portion 52 or upper front portion 54 to indicate to users how the device is actuated. FIG. 3 illustrates actuation of the device.

Opening 50, which receives extension portion 22 of stem 20, is shown as circular. A great variety of other shapes and configurations are acceptable, it being important only that a portion of upper surface 48 of shroud member 28 bear on extension portion 22 to tilt stem 20 when shroud member 28 is pivoted.

Tilt valves of a type suitable for use in this invention are well known in the prior art. A variety of such valves may be used. Bracket 26 and shroud member 28 are preferably constructed of hardened plastic material. Each of such principal parts are preferably integrally molded of such plastic. A wide variety of other materials would be acceptable.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. A wall-mountable aerosol dispensing device comprising:

a cylindrical aerosol container including, at a valved end, a valve cup and tilt-actuatable valve stem protruding therefrom along the container axis;

a wall-mountable bracket receiving and supporting said container, said bracket having securing means preventing radial movement of said container and pivot bearings thereon spaced from said valved end and defining a pivot axis parallel to a radius of said container; and a shroud member substantially enclosing said container and said bracket and pivotally attached to said bracket through pivot means engaged with said pivot bearings, said shroud member defining an opening receiving and engaging said stem.

2. A wall-mountable receptacle for a cylindrical aerosol container of the type including, at the valved end, a valve cup and a tilt-actuatable valve stem protruding therefrom along the container axis, comprising:

a wall-mountable bracket receiving and supporting said container, said bracket having securing means preventing radial movement of said container and pivot bearings thereon spaced from said valved end and defining a pivot axis parallel to a radius of said container; and a shroud member substantially enclosing said container and bracket and pivotally attached to said bracket through pivot means engaged with said pivot bearings, said shroud member defining an opening receiving and engaging said stem whereby to tilt said stem when said shroud member is pivoted on said pivot axis.

* * * * *